US007027001B2

(12) United States Patent
Thudor et al.

(10) Patent No.: US 7,027,001 B2
(45) Date of Patent: Apr. 11, 2006

(54) DUAL-BAND PLANAR ANTENNA

(75) Inventors: Franck Thudor, Rennes (FR); François Baron, Cesson Sevigne (FR); Françoise Le Bolzer, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/963,937

(22) Filed: Oct. 13, 2004

(65) Prior Publication Data

US 2005/0083239 A1 Apr. 21, 2005

(30) Foreign Application Priority Data

Oct. 17, 2003 (FR) ..... 03 50701

(51) Int. Cl.
*H01Q 13/12* (2006.01)

(52) U.S. Cl. ..... 343/769; 343/767

(58) Field of Classification Search ..... 343/769, 343/767, 700 MS

See application file for complete search history.

(56) References Cited

U.S. PATENT DOCUMENTS

| | | | | |
|---|---|---|---|---|
| 4,006,481 A | | 2/1977 | Young et al. | 343/770 |
| 4,206,660 A | * | 6/1980 | Brown | 343/769 |
| 4,893,126 A | * | 1/1990 | Evans | 342/175 |
| 5,714,961 A | * | 2/1998 | Kot et al. | 343/769 |
| 5,905,471 A | * | 5/1999 | Biebl et al. | 343/769 |
| 6,219,002 B1 | * | 4/2001 | Lim | 343/769 |
| 6,753,824 B1 | * | 6/2004 | Thudor et al. | 343/769 |
| 6,828,942 B1 | * | 12/2004 | Louzir et al. | 343/769 |

FOREIGN PATENT DOCUMENTS

| | | |
|---|---|---|
| EP | 1 367 673 A1 | 3/2003 |
| FR | 1 012 833 A | 7/1950 |
| FR | 2 833 764 A1 | 6/2003 |

OTHER PUBLICATIONS

Nedil M. et al., "A New Back-to-Back Slot Bow-Tie Antenna For Milimeter-Wave Applications" CCECE 2003. Canadian Conference On Electrical And Computer Engineering. Montreal, Canada May 4-7, 2003, Canadian Conference Engineering, New York, NY IEEE, US vol. 3 of 3 4 mai 2003 (May 4, 2003), pp. 1433-1436, XPO10654347 ISBN: 0-7803-7781-8.

* cited by examiner

*Primary Examiner*—Hoang V. Nguyen
(74) *Attorney, Agent, or Firm*—Joseph S. Tripoli; Robert D. Sheld; Brian J. Cromarty

(57) ABSTRACT

The invention relates to a dual-band planar antenna formed by at least one slot of closed shape fabricated on a printed substrate having a perimeter equal to $k\lambda_f$, and two supply lines supplying power to the slot via two accesses separated by $(2m+1)\lambda_f/4$, where $\lambda_f$ is the guided wavelength in the slot and k and m integers greater than 0, the slot comprising means modifying the operating frequency, one of the supply lines being situated on the said means. The invention is especially applicable to antennas used in domestic wireless networks (IEEE802-11a or Hyperlan 2 standards.

11 Claims, 12 Drawing Sheets

ASA according to the first embodiment (access 1) at 5.4 GHz

ASA according to the first embodiment (access 2) at 5.6 GHz

DUAL-BAND PLANAR ANTENNA

This application claims the benefit, under 35 U.S.C. 119, of France patent application No. 0350701 filed Oct. 17, 2003.

The present invention relates to a planar antenna and more especially to a dual-band planar antenna of the slot type designed for wireless networks operating in distinct frequency bands.

BACKGROUND OF THE INVENTION

In regard to the deployment of wireless mobile networks in the domestic environment, the design of the antennas is confronted with a particular problem that results from the manner in which the various frequencies are allocated to these networks. Thus, in the case of domestic wireless networks using the IEEE802.11a or Hyperlan2 standard, two distinct frequency blocks, operating in the 5 GHz band, have been allocated to the various service providers as can be seen in the table below.

TABLEAU A

| Technology | Application | Frequency bands (GHz) |
|---|---|---|
| Europe BRAN/ HYPERLAN2 | Domestic networks | (5.15–5.35) (5.47–5.725) |
| US-IEEE 802.11a | Domestic networks | (5.15–5.35) (5.725–5.825) |

For this reason, in order to cover the two frequency bands, whether it be for a single standard or for two standards simultaneously, various solutions have been proposed.

The most obvious solution consists in using a broadband antenna that covers, at the same time, the two frequency bands defined above. However, this type of antenna covering a broad band of frequencies generally has a complex structure and is expensive. The use of a broadband antenna also has other drawbacks such as the degradation in the performance of the receiver owing to the width of the noise band and to the scrambler capable of operating over the whole band covered by the antenna, this band also comprising the band not allocated to the specific applications in the range 5.35 GHz to 5.47 GHz.

The use of a broadband antenna implies more severe filtering constraints for the transmitter in order to conform to power transmission profiling masks, namely the maximum powers allowed for transmissions both within the allocated band and outside of this band. This leads to additional losses and a higher cost for the equipment.

Furthermore, in wireless networks, at any given time an antenna covers a channel having a bandwidth of around 20 MHz situated in one or the other of the two bands. An alternative solution allowing the drawbacks associated with broadband antennas to be avoided would be to use an antenna whose band of frequencies can be adjusted.

Thus, planar antennas formed, as shown in FIG. 1, by an annular slot 1 are known and which operate at a given frequency f determined by the perimeter of the slot, this slot being supplied by a supply line. More precisely, on a substrate formed by a normal printed circuit metallized on both faces, the annular slot 1, which can be of circular shape or of any other closed shape, is fabricated by etching of the side forming the ground plane of the antenna. The supply line 2 is provided for supplying power to the slot 1, notably by electromagnetic coupling. This is, for example, formed by a line using microstrip technology, positioned on the opposite side of the substrate from the slot 1 and, in the embodiment shown, oriented radially with respect to the circle forming the slot.

The microstrip line—annular slot transition of the antenna is arranged in a known manner such that the slot 1 is located in a short-circuit plane of the line, in other words in a region where the currents are highest. Thus, the supply line after the line-slot transition has a length of around λm/4, where λm is the guided wavelength under the microstrip line. This length can be an odd multiple of $\lambda_m/4$ if the line is terminated by an open circuit, or an even multiple of $\lambda_m/4$ if the line is terminated by a short circuit. Moreover, the diameter p of the slot operating in its fundamental mode is chosen in a known fashion such that $p=\lambda_f$, where $\lambda_f$ is the guided wavelength in the slot.

Under these conditions, the distribution of the fields in the slot is as shown in FIG. 2 with two regions of maximum field (CO) and two regions of minimum field (CC). For this reason, it is possible to place a second supply line on the slot at a short-circuit region CC without however degrading the matching at the access on the first supply line while still achieving a good isolation between the two accesses.

Accordingly, the present invention uses this type of structure to obtain a dual-band antenna.

BRIEF SUMMARY OF THE INVENTION

Consequently, the subject of the present invention is a dual-band planar antenna formed by at least one slot of closed shape fabricated on a printed substrate having a perimeter equal to $k\lambda_f$, the said slot being supplied by two supply lines, the two lines supplying power to the slot via two accesses separated by $(2m+1)\lambda_f/4$, where $\lambda_f$ is the guided wavelength in the slot and k and m integers greater than 0, characterized in that the slot comprises means modifying the operating frequency, one of the supply lines being situated on the said means.

According to a first embodiment, the means modifying the operating frequency are constituted by protrusions cut out from the slot. The protrusions can be placed on the inner rim of the slot or on the outer rim of the slot. They are square or rectangular in shape. The dimensions of the protrusion as a function of the two operating frequencies are given by the equation:

$$2\times\frac{f_2-f_1}{f_2+f_1}=A\times\frac{W_cL_c}{\pi R_{moy.}^2}$$

where $f_1$ and $f_2$ are the central operating frequencies on each of the supply lines, $W_C$ the width of the protrusion, $L_C$ the length of the protrusion, $R_{moy}$ the mean radius of the slot and A a multiplier coefficient.

According to another embodiment of the present invention, the means modifying the operating frequency are formed by a symmetric gradual variation of one of the rims of the slot near the open-circuit regions or near the short-circuit regions. In this case, one of the rims can be circular and the other elliptical.

According to another feature of the present invention, the supply lines are coupled with the slot according to a line-slot coupling of the Knorr type.

According to yet another feature of the present invention, the supply lines are magnetically coupled with the slot according to a tangential line-slot transition.

BRIEF DESCRIPTION OF THE DRAWINGS

Other features and advantages of the present invention will be described below with reference to the appended drawings in which.

DESCRIPTION OF PREFERRED EMBODIMENTS

Various embodiments of the present invention will now be described, with reference to FIGS. 3 to 19. In these figures, in order to simplify the description, the same elements may be given the same reference numbers.

Figure 1:
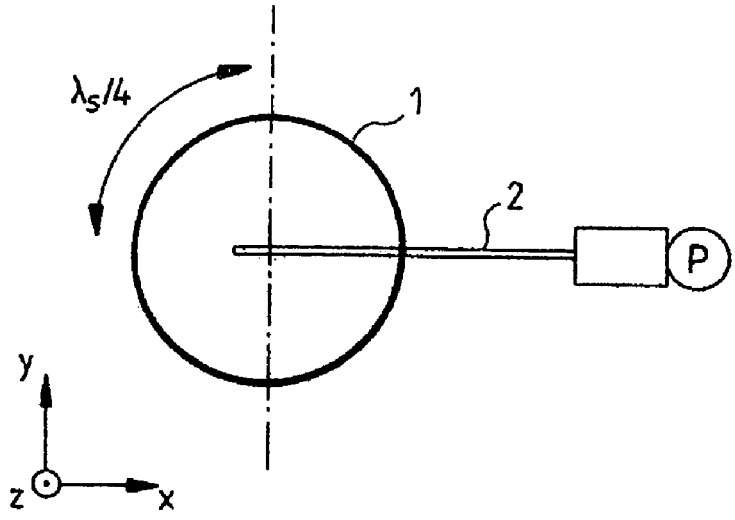
FIG. 1, previously described, is a schematic plan view of an antenna of the annular slot type supplied by a microstrip line, according to a line-slot transition of the Knorr type.
Figure 2:
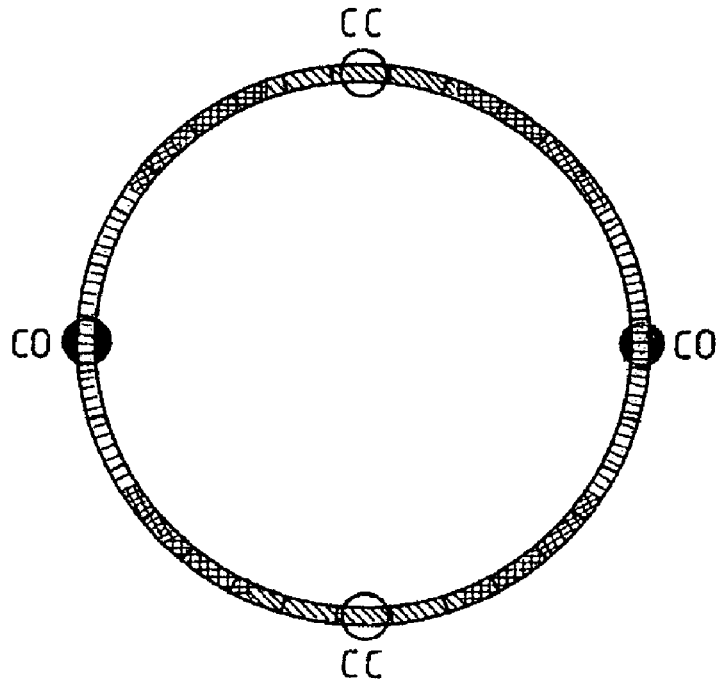
FIG. 2 is a schematic view showing the field distribution inside the annular slot.
Figure 3:
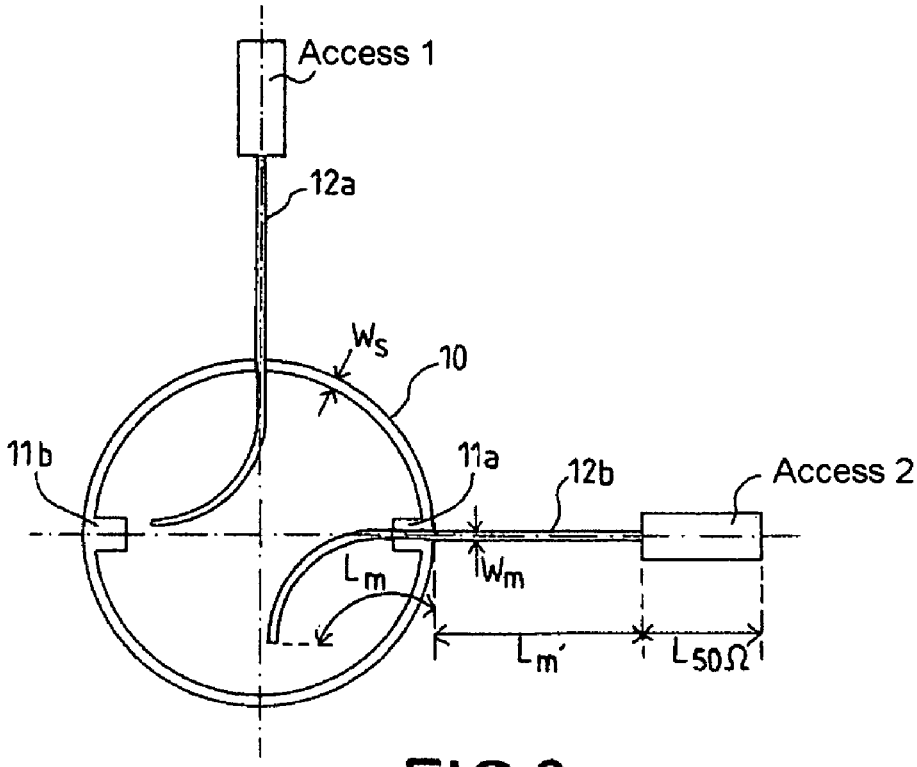
FIG. 3 is a schematic top plan view of a first embodiment of a dual-band planar antenna according to the present invention.
Figure 4:
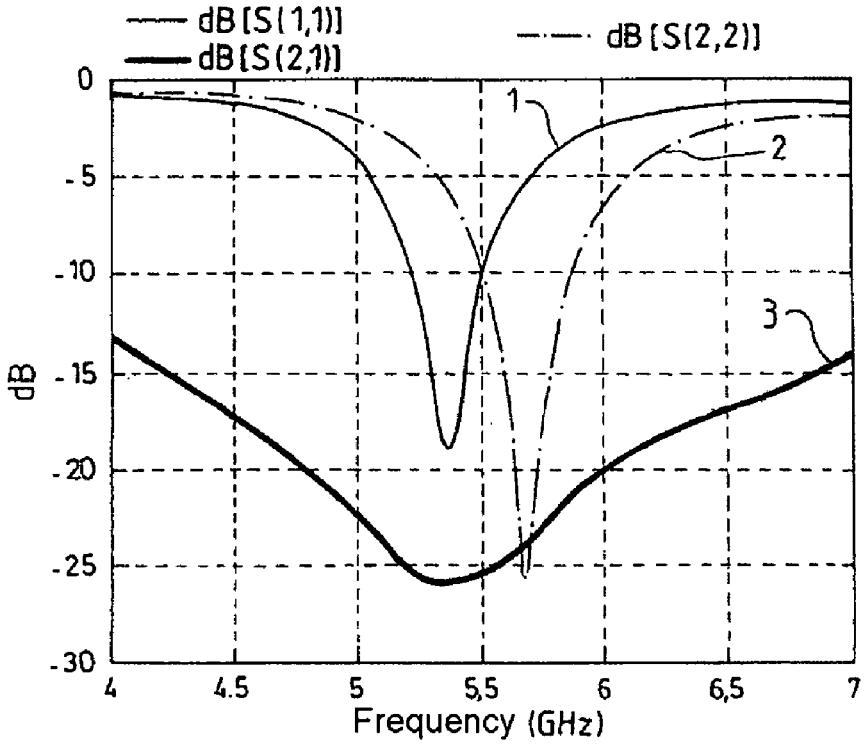
FIG. 4 shows the matching and isolation curves of the antenna shown in FIG. 3.

FIGS. 3 to 5 relate to a first embodiment of the present invention. In this case, as shown in FIG. 3, the dual-band planar antenna is essentially formed by a circular annular slot 10, fabricated in a known manner on a printed substrate. According to the present invention, protrusions 11*a*, 11*b* are introduced into the slot. In this embodiment, the protrusions 11*a*, 11*b* consist of square cutouts provided on the internal perimeter of the slot 10. The two protrusions 11*a*, 11*b* are diametrically opposed in the case of an annular slot 10 that is dimensioned so as to operate in its fundamental mode, as explained above.

Furthermore, in order to be able to operate over two distinct frequency bands, the antenna according to the present invention comprises a first supply line 12*a* which crosses the annular slot 10 at equal distances from the two protrusions 11*a*, 11*b*, as shown in FIG. 3. The coupling between the line 12*a*, formed in the conventional manner using microstrip technology, is a coupling of the Knorr type in the embodiment shown. In addition, the annular slot can also be supplied by a second supply line 12*b*. This second supply line 12*b* is coupled to the slot according to a Knorr-type coupling at the protrusion 11*a*.

For a better understanding of the present invention, a simulation of a dual-band antenna such as that shown in FIG. 3 is produced. In this case, the following dimensions have been used:

$R_{int}$=6.6 mm, $R_{ext}$=7 mm, $R_{moy}$=6.8 mm, $W_s$=0.4 mm, $W_m$=0.3 mm, $L_m$=$L_m$'=8.5 mm, $L_{50\Omega}$=4.6 mm and $W_{50\Omega}$=1.85 mm.

The simulation was carried out using a commercially available electromagnetic software package (IE3D, from the company Zeland). In addition, the square protrusions are 1.29 mm on each side. The results of the simulation are presented in FIGS. 4 and 5.

FIG. 4 shows the matching curves S11 and S22 when the access is through 1 for the curve 1 or when the access is through 2 for the curve 2, respectively. Thus, it can be seen from the curves that the operation through the access 1 is lower in frequency than for a standard annular slot, namely 5.35 GHz instead of 5.625 GHz, whereas the operation through the access 2, shown by the curve 2, is similar to that of a standard annular slot antenna, namely 5.68 GHz instead of 5.625 GHz. In this case, a dual-band structure with closely-spaced operating bands is therefore obtained. According to the curves, it can therefore be seen that the matching bands are of about the same width, whichever access is considered, and that the isolation between the accesses is greater than −21 dB on the two matching bands, the isolation being given by the curve 3.

Figure 5A:
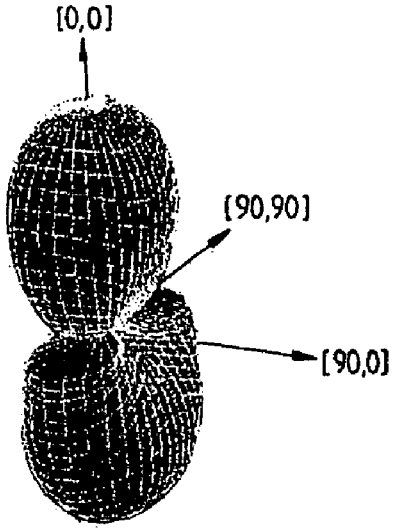
FIGS. 5*a* and 5*b* show radiation patterns of the slot antenna according to the present invention when the supply is through the access 1 and through the access 2, respectively.
Figure 5B:
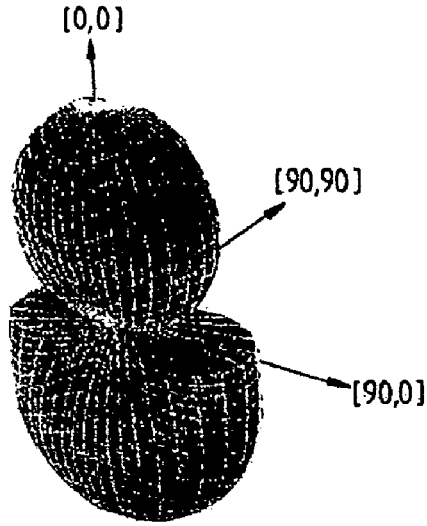

Furthermore, as shown in FIGS. 5*a* and 5*b*, the radiation pattern of the dual-band planar antenna in FIG. 3 is similar to that of a circular slot antenna, FIG. 5*a* showing the radiation pattern when the slot is supplied through the access 1 at 5.4 GHz, whereas FIG. 5*b* shows the radiation pattern when the slot is supplied through the access 2 at 5.6 GHz.

Figure 6:
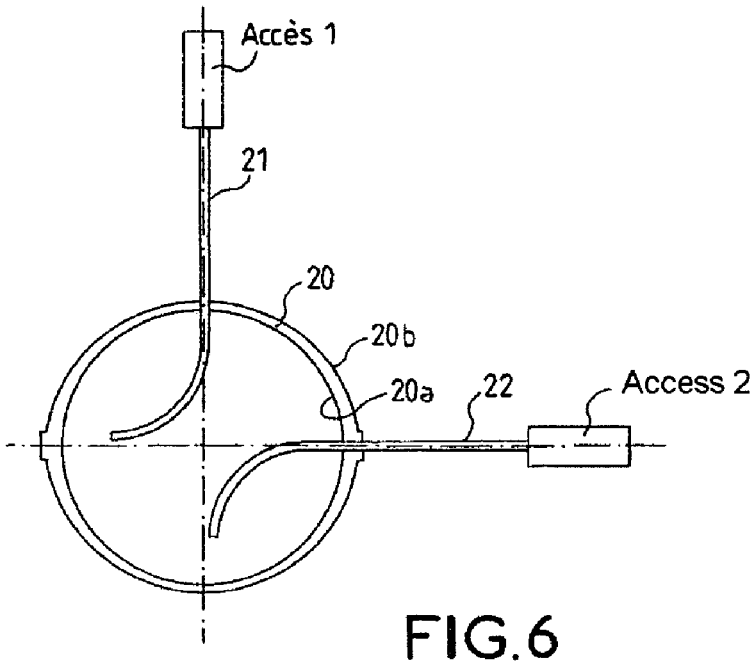
FIG. 6 is a schematic top plan view of a second embodiment of a dual-band planar antenna according to the present invention.
Figure 7:
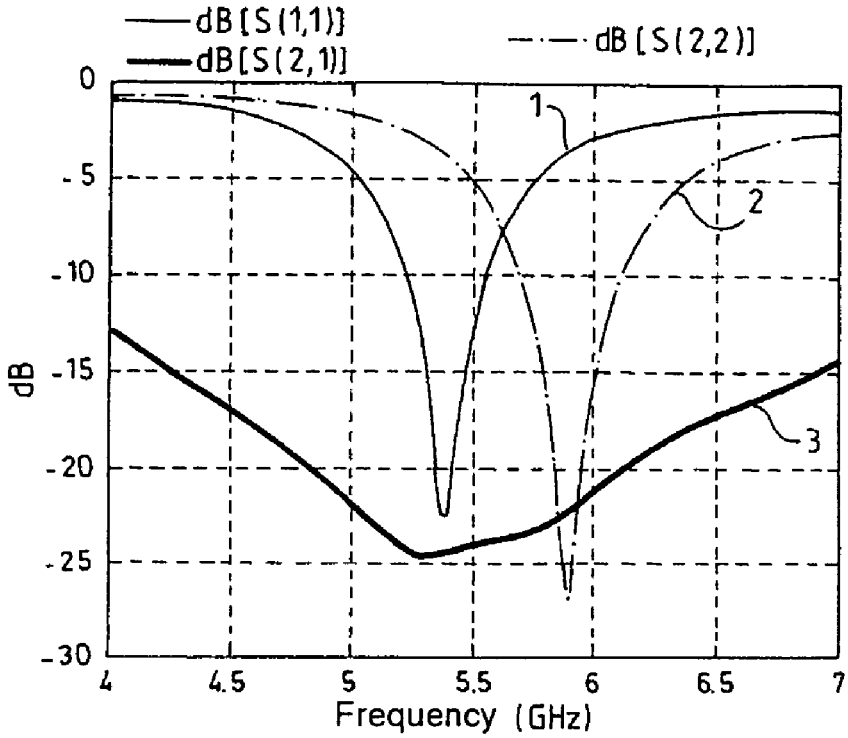
FIG. 7 shows the matching and isolation curves of the antenna shown in FIG. 6.

With reference to FIGS. 6 and 7, a second embodiment of the present invention will now be described. In this case, the dual-band planar antenna is formed by an annular slot 20 having a circular inner rim 20*a* and an elliptical outer rim 20*b*. The perturbations are therefore obtained by the resulting gradual widening of the slot.

As shown in FIG. 6, this slot 20 is supplied by a first supply line 21, fabricated using microstrip technology and supplying the slot 20, according to the Knorr method, at a region of minimum field which is located between the two protrusions. This line 21 corresponds to the access 1. In addition, the annular slot 20 is also supplied by a second supply line 22. This supply line 22 crosses the slot 20 at the protrusions formed by the widest sections of the slot, the supply being effected by electromagnetic coupling according to the Knorr method.

This structure has also been simulated using the IE3D package, with a mean radius $R_{moy}$=6.8 mm. In addition, the protrusions are effected by taking a slot width of 0.4 mm at the access 1, namely at the intersection with the supply line 21, and a width of 0.8 mm at the access 2, namely at the intersection with the supply line 22. Between these two points, the width of the slot varies progressively from 0.4 mm to 0.8 mm. The results of the simulation are given by the curves in FIG. 7. As for the first embodiment, the operating band is different for the access 1, giving the curve 1, and for the access 2, giving the curve 2. Thus, the operating frequency is 5.39 GHz when the access 1 is supplied and 5.905 GHz when the access 2 is supplied. This second embodiment therefore allows the operating frequency through the access 1 and the operating frequency through the access 2 to be modified.

Figure 8:
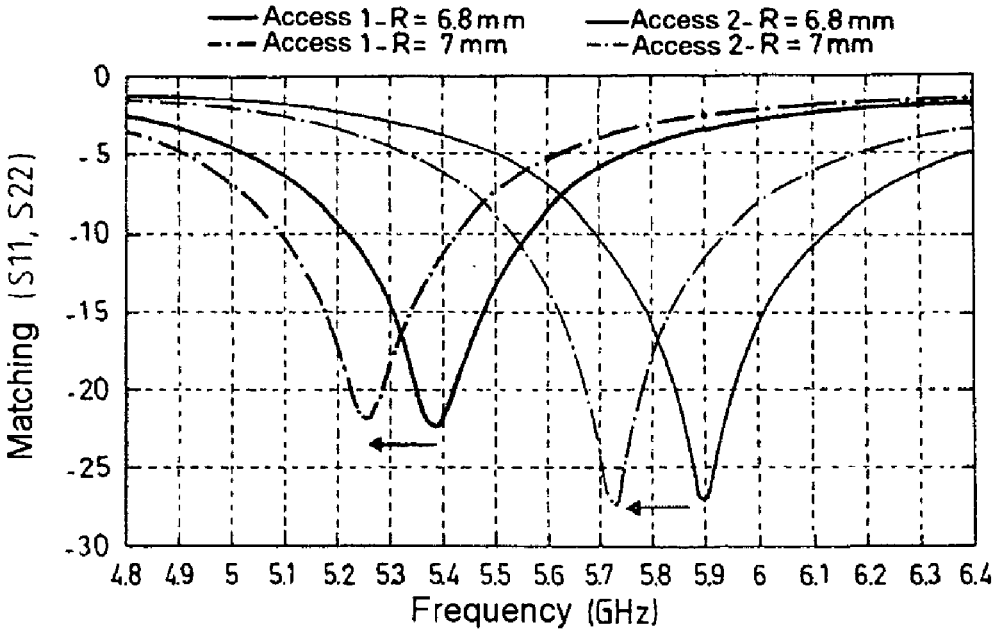
FIG. 8 shows the matching curves S11 and S22 as a function of frequency when the mean radius of the annular slot antenna is varied.
Figure 9:
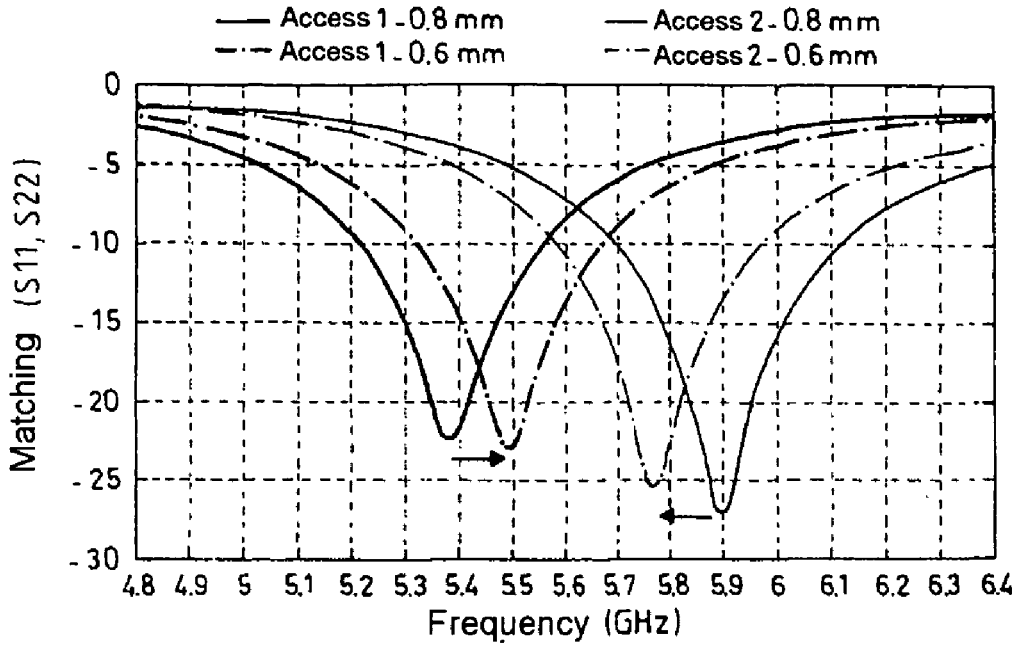
FIG. 9 shows the matching curves S11 and S22 as a function of the frequency of an annular slot antenna when the dimensions of the protrusion are varied.
Figure 10:
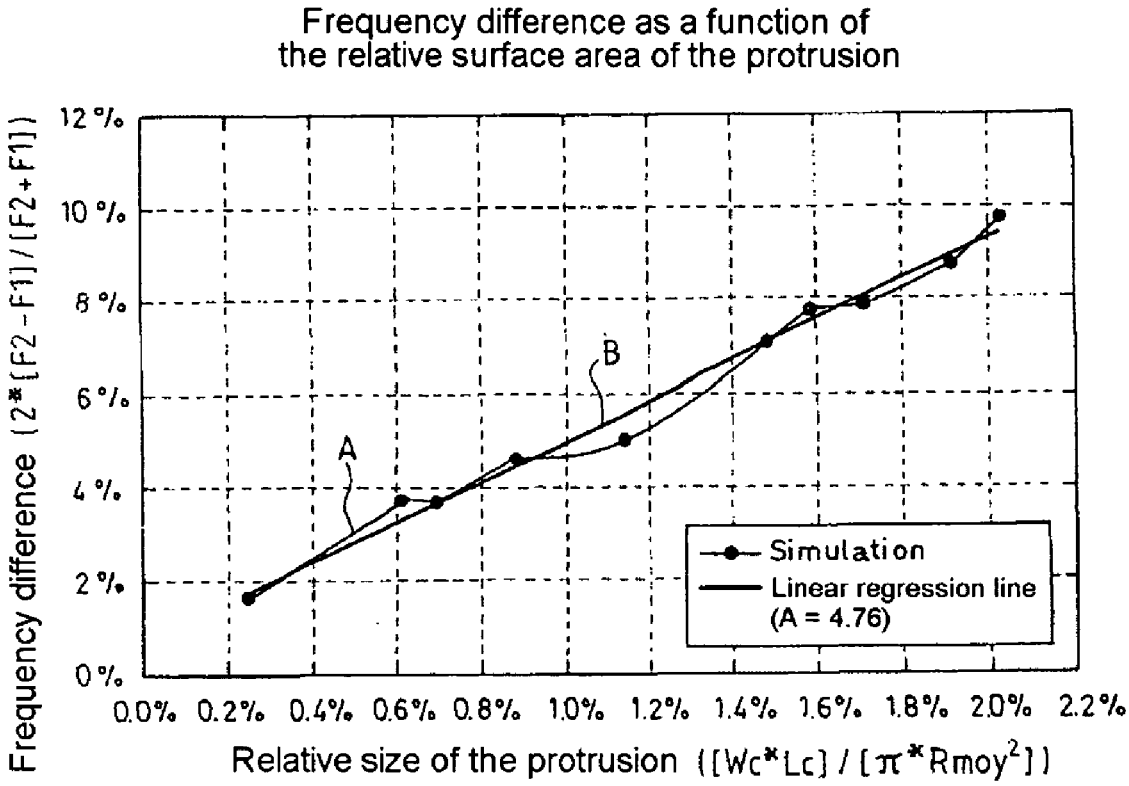
FIG. 10 is a curve showing the difference in frequency as a function of the relative size of the protrusion.

With reference to FIGS. 8, 9 and 10, certain modifications will now be described which can be effected, notably on the embodiments in FIGS. 3 and 6, in order to obtain an operation in the desired frequency bands.

Thus, as shown in FIG. 8, it can be seen that a modification in the mean radius of the initial annular slot allows the operating frequency of the two sub-bands to be modified. If the mean radius $R_{moy}$ is increased, the operating frequency of the two sub-bands is reduced, as is illustrated by the curves in FIG. 8 in which the curves in bold show the matching as a function of frequency for a mean radius R=6.8 mm, whereas the thin curves show the matching as a function of frequency for a mean radius of 7 mm.

Moreover, the dimensions of the perturbation created in the slot can be reduced to obtain operating modes that are less separated in frequency, as is illustrated in FIG. 9. In this figure, the curves in bold represent, in the second embodiment, a widening of the slot to 0.8 mm, whereas the thin curves represent a widening of the slot to 0.6 mm.

Based on the above observations, a design rule has been found for determining the dimensions of the protrusion in the case of the embodiment in FIG. 3. This design rule allows the size of the protrusion to be determined as a function of the difference between the two chosen operating frequencies, yielding the equation:

$$2 * \frac{f_2 - f_1}{f_2 + f_1} = A * \frac{W_c * L_c}{\pi * R_{moy}^2}$$

where $f_1$ and $f_2$ are the central operating frequencies on the access 1 and on the access 2, respectively, $W_c$ the width of the protrusion, $L_c$ the length of the protrusion, $R_{moy}$ the mean radius of the slot and A a multiplier coefficient.

The simulations yielded the curve in FIG. 10 which shows the frequency difference as a function of the relative size of the protrusion.

Various possible variants for the dual-band planar antenna according to the invention will now be described with reference to FIGS. 11A, 11B to 16A, 16B.

The figures with reference A are schematic drawings of the antenna, whereas the figures with reference B give the matching and isolation curves, namely curve 1 for the access 1, curve 2 for the access 2 and curve 3 for isolation.

Figure 11A:
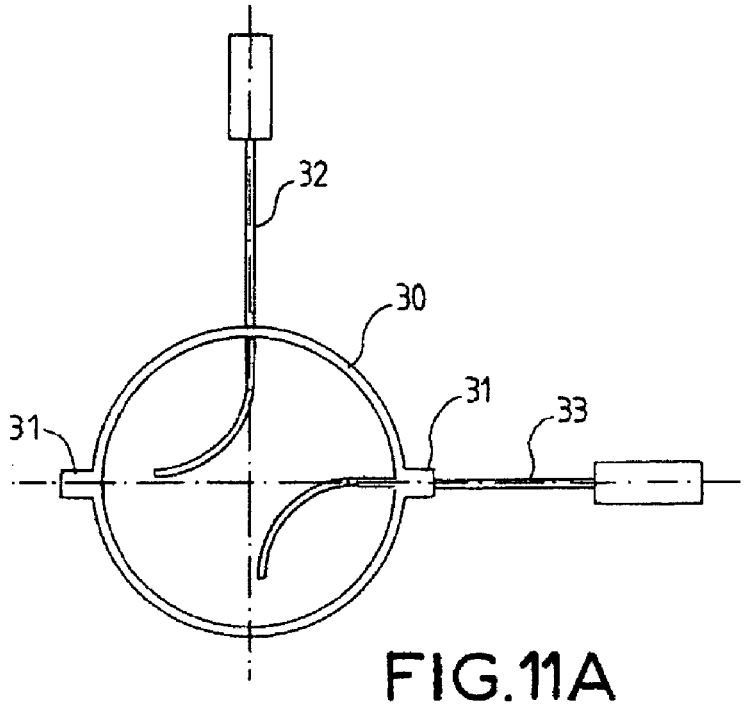
FIGS. 11*a*, 11*b*, FIGS. 12*a*, 12*b*, FIGS. 13*a*, 13*b*, FIGS. 14*a*, 14*b*, FIGS. 15*a*, 15*b*, FIGS. 16*a*, 16*b*, are respective schematic plan views and curves showing the matching and isolation as a function of the frequency of various embodiments of dual-band antennas according to the present invention.
Figure 11B:
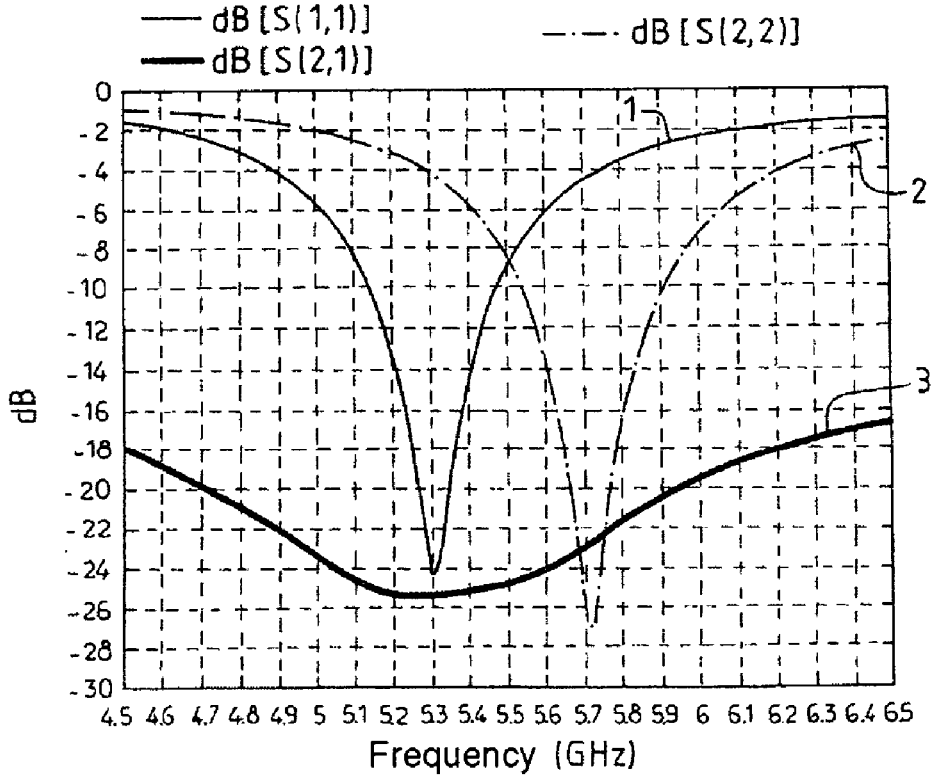

In FIG. 11A, a dual-band planar antenna according to the present invention is shown schematically, comprising a circular annular antenna 30 having two protrusions 31 provided on the outside, on the outer rim of the annular antenna 30. In this case, the protrusions 31 are square in shape. As described with reference to FIG. 3, this annular slot is supplied by a first supply line 32 crossing the slot at equal distances from the two protrusions 31 and by a second supply line 33 crossing the slot at one of the protrusions 31. The simulation results for this dual-band antenna are given in FIG. 11B, in the case of a square protrusion on the outer rim with the dimension $W_c$=1.29 mm.

Figure 12A:
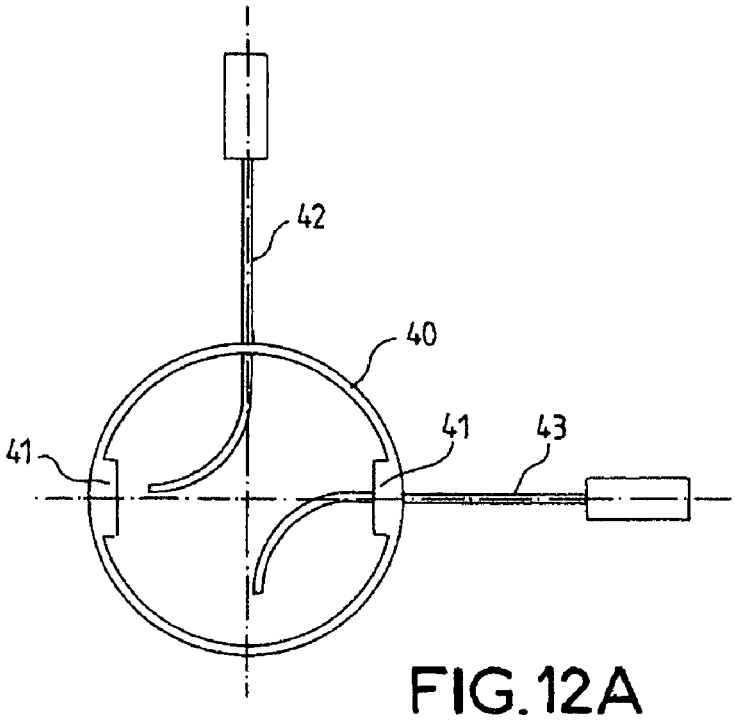
Figure 12B:
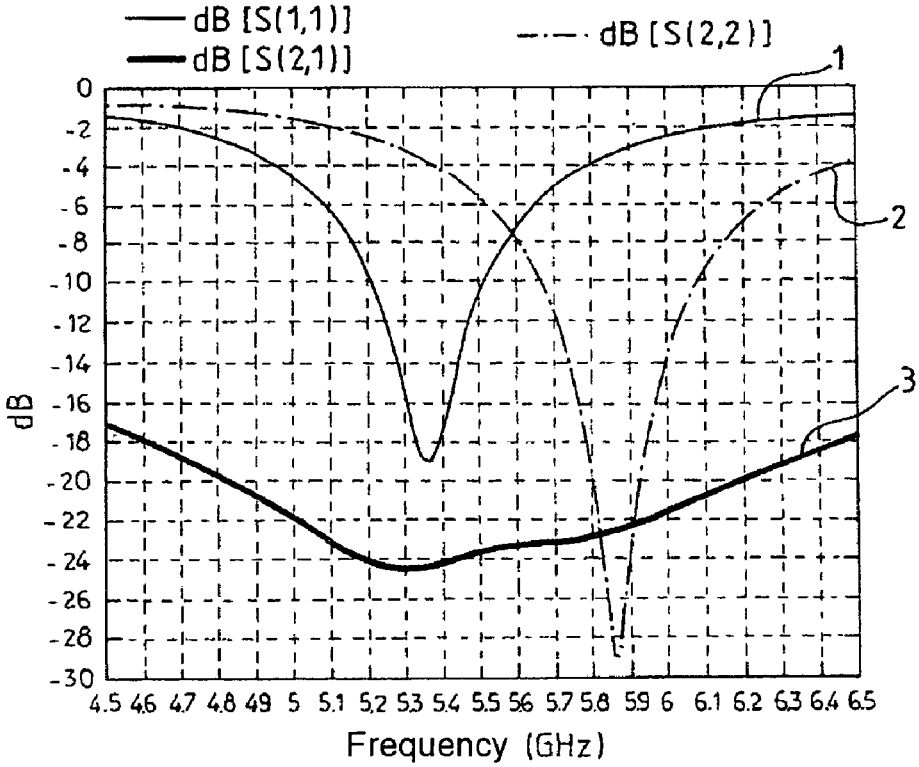

FIG. 12A shows a dual-band planar antenna formed by a circular annular slot 40 having two rectangular protrusions 41 on the inner rim of the slot 40. As in FIG. 11A, this annular slot is supplied by two supply lines 42, 43 where, as in FIG. 11A, one is placed equidistant from the two protrusions and the other at one of the protrusions. The simulation results for this dual-band antenna are given in FIG. 12B.

Figure 13A:
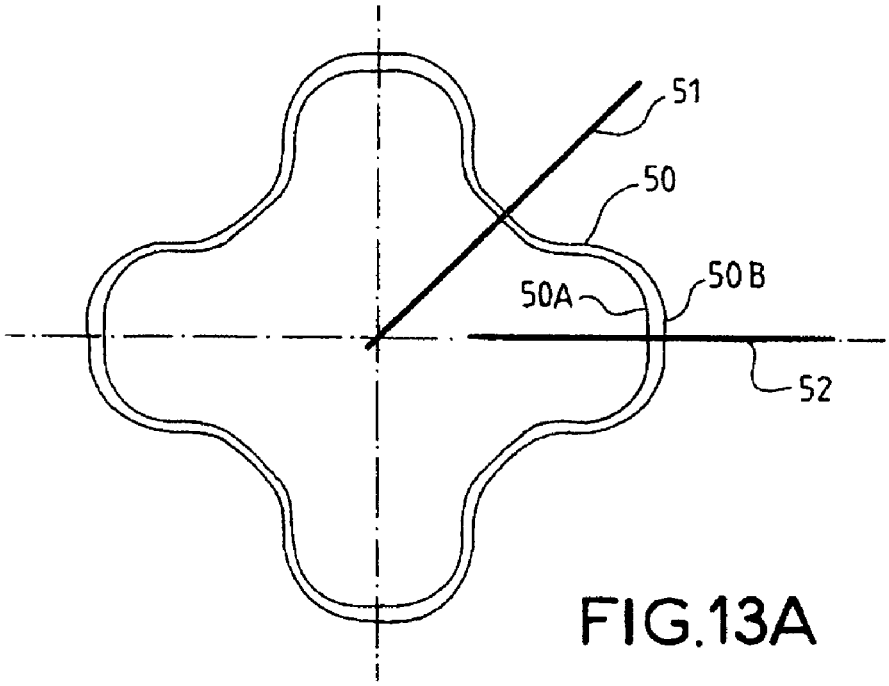
Figure 13B:
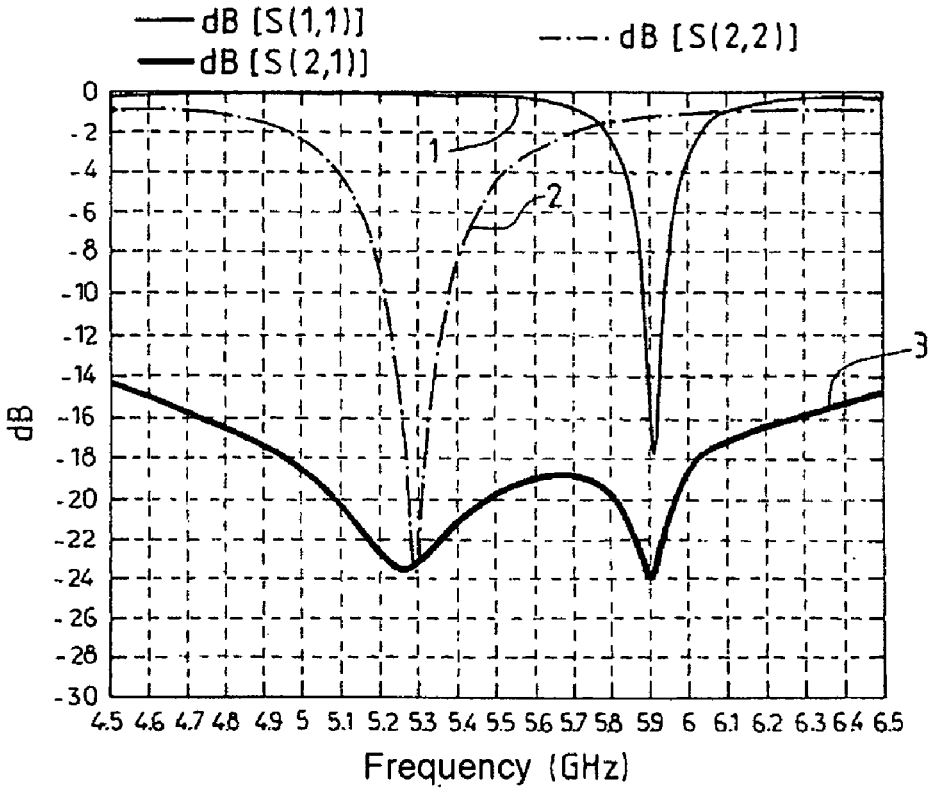

FIG. 13A shows an annular slot 50 in the shape of a clover leaf operating in its first harmonic mode. For this reason, the slot has a perimeter p equal to $2\lambda_f$. In this case, the protrusions are obtained by a widening of the slot, as indicated by 50A and 50B. As in the case of the embodiment in FIG. 6, this slot 50 is supplied by two supply lines 51 and 52, one of the supply lines 52 crossing the slot at its largest part, whereas the other supply line 51 crosses the slot 50 at its narrowest part. The simulation results for a dual-band antenna of this type are given in FIG. 13B.

The embodiments in FIGS. 14A to 16A show a dual-band antenna formed from two concentric annular slots. The use of multiple slots allows the band to be broadened. In this case, the protrusions can be positioned on the first and the second slots for the same access or different accesses or simply on one or the other of the two slots.

Figure 14A:
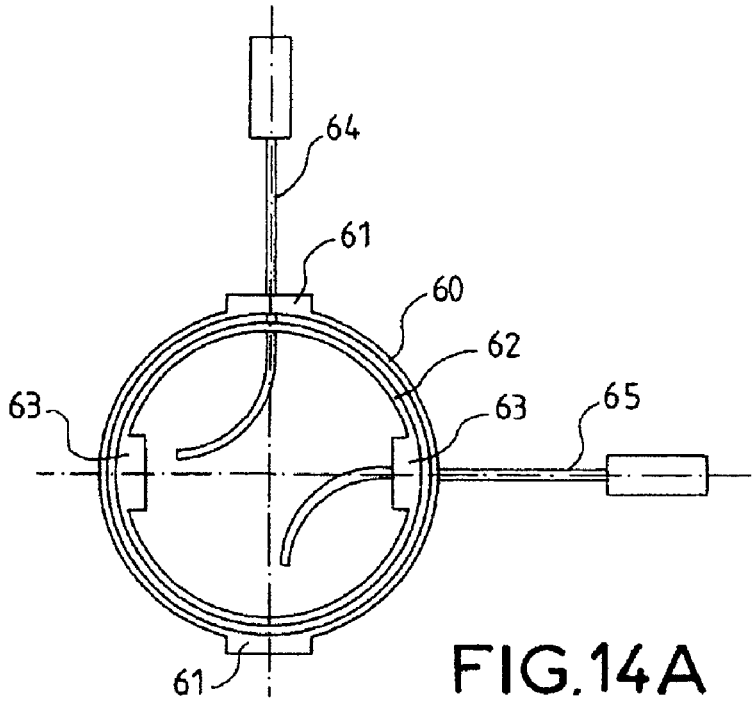

Accordingly, the dual-band antenna shown in FIG. 14A comprises two concentric annular slots 60, 62. In this embodiment, the outer annular slot 60 has two rectangular protrusions 61 on its outer rim, whereas the inner circular slot 62 has two rectangular protrusions 63 on its inner rim. In this embodiment, the protrusions 61 are perpendicular to the protrusions 63. As in the embodiment in FIG. 3, the annular slots are supplied by a first common supply line 64 that cuts across the two slots in the direction of the protrusions 61 and by a second common supply line 65 that cuts across the two slots in the direction of the protrusions 63.

Figure 14B:
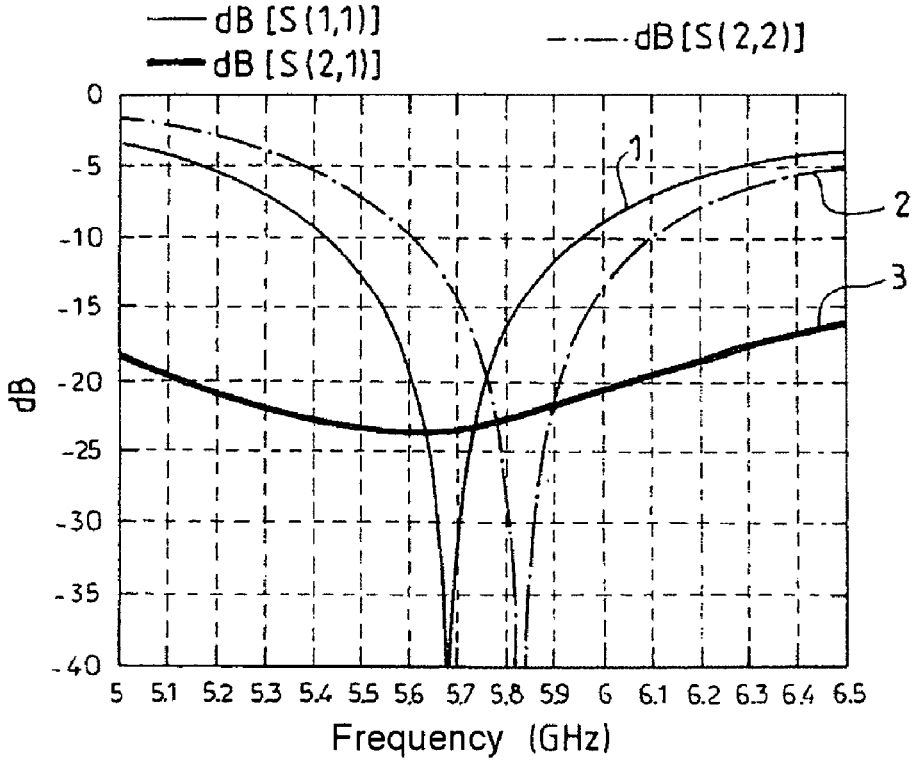

The results of the simulation for the antenna in FIG. 14A are given in FIG. 14B.

Figure 15A:
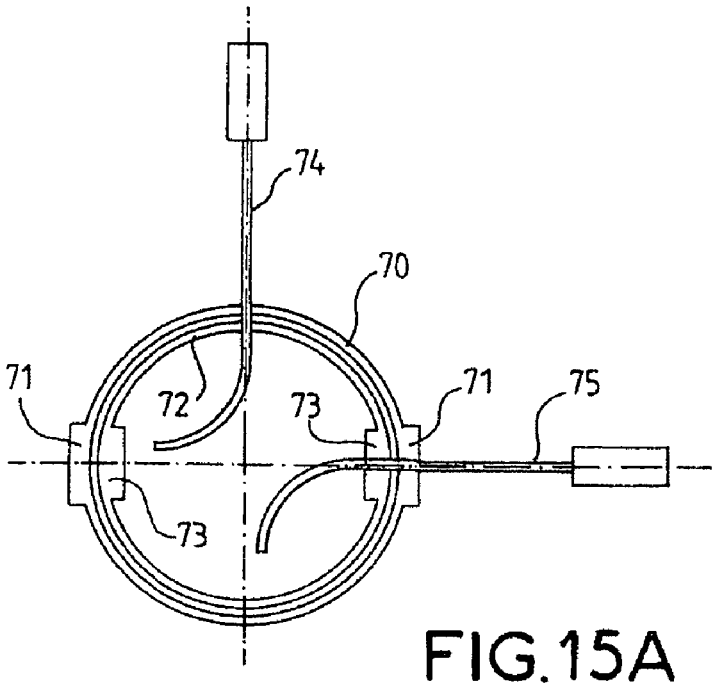

FIG. 15A shows an embodiment in which the two slots are formed by concentric circular annular slots 70 and 72. In this case, the protrusions 71 and 73 are placed in the same plane, with the protrusions 71 positioned on the outer rim of the outer slot 70 and the protrusions 73 positioned on the inner rim of the inner slot 72. In this case, the first supply line 74 is symmetrically positioned between the protrusions 71, 73, whereas the second supply line 75 cuts across the two annular slots at the protrusions 71 and 73.

Figure 15B:
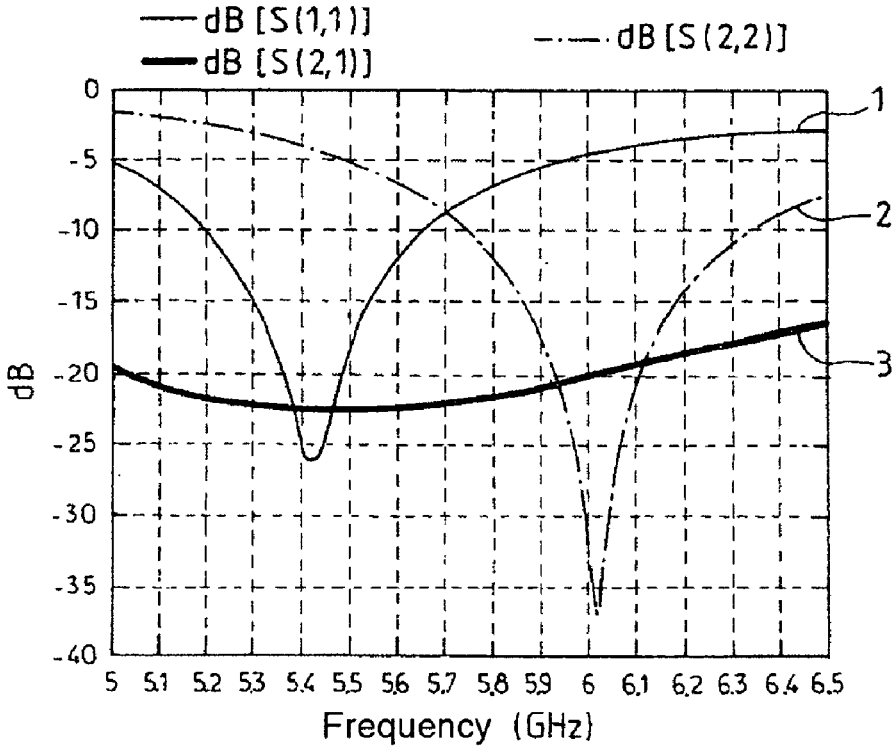

The simulation results for a slot such as is shown in FIG. 15A are given in FIG. 15B.

Figure 16A:
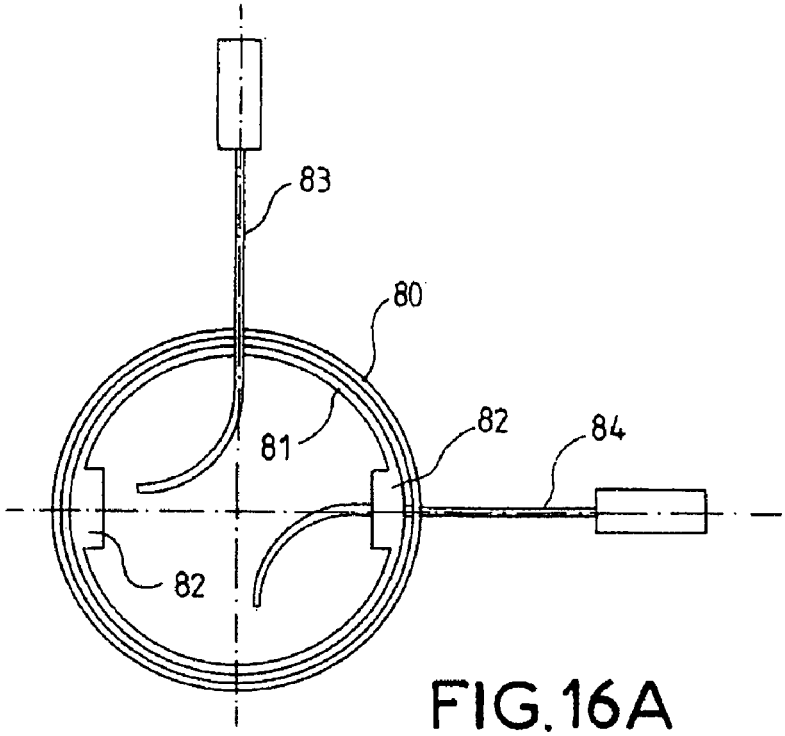

According to another embodiment shown in FIG. 16A, the multiple slots are formed by two concentric circular annular slots 80, 81. In this case, only one of the slots, namely the annular slot 81, has rectangular protrusions on its inner rim 82. These two slots are respectively supplied by a first supply line 83 cutting across the slots at equal distances from the two protrusions 82 and by a second supply line 84, cutting across the slots at the protrusions 82.

Figure 16B:
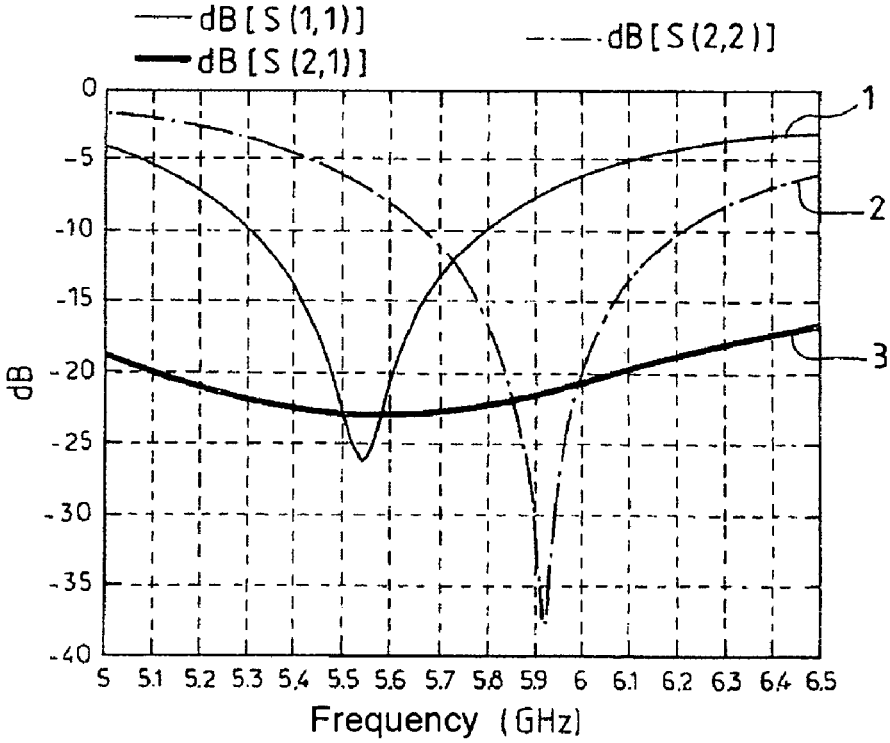

The simulation results for such a dual-band antenna are given in FIG. 16B.

Figure 17:
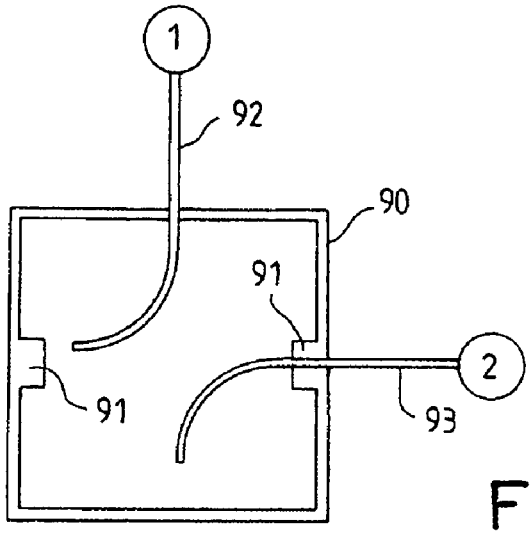
FIG. 17 and FIG. 18 show antennas according to the present invention in which the closed shape of the slot is not circular.
Figure 18:
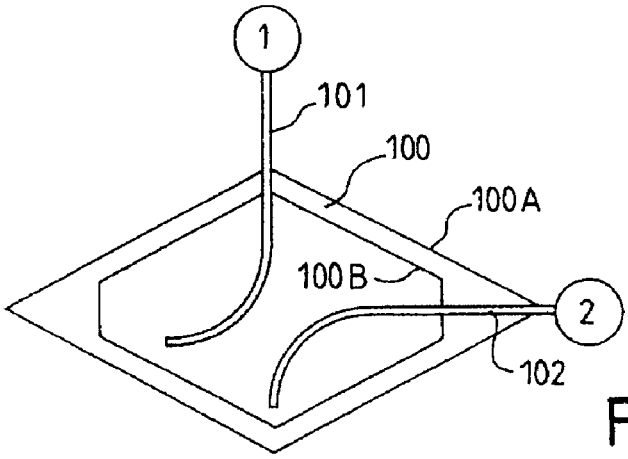

FIGS. 17 and 18 show other embodiments of the present invention. In this case, the slot antenna has a shape other than circular, namely a square slot in the case of FIG. 17. This square slot, with reference 90, has inner protrusions 91 on two sides and is supplied, as in the case of the embodiment in FIG. 3, by two supply lines, namely one supply line 93 cutting across the slot 90 at one of the protrusions 91 and one supply line 92 cutting across the slot at equal distances from the two protrusions 91.

FIG. 18 shows a slot in the shape of a lozenge 100. In this case, the outer rim of the slot is a lozenge 100A, whereas the inner rim 100B has a polygonal shape having a straight section at two of the corners, so as to obtain a protrusion formed by a widening of the slot. As in the case of the embodiment in FIG. 7, the slot is supplied by two supply lines 101 and 102, one of the lines 102 cutting across the slot at its widened corner, whereas the other line 101 cuts across the slot at a corner equidistant from the two widened corners.

Figure 19:
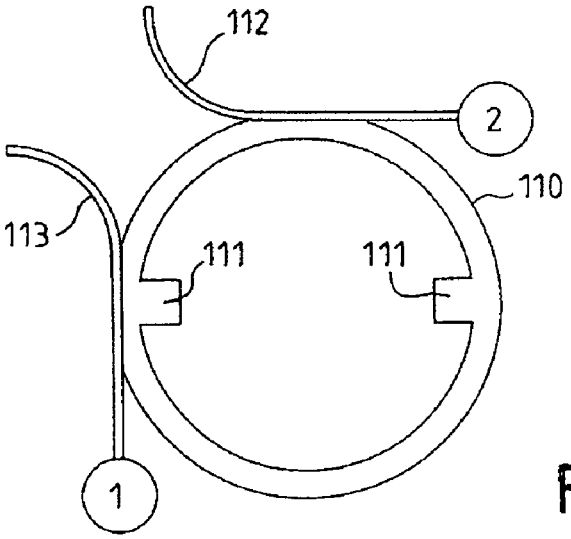
FIG. 19 is a schematic view of another embodiment of the present invention in which the supply lines are tangential to the slot.

FIG. 19 shows an embodiment of a dual-band antenna formed by an annular slot 110, having two protrusions 111 on its inner rim. In this case, the annular slot is supplied through two accesses 1, 2, by two supply lines 112 and 113 which create a magnetic coupling tangentially to the slot 110, one of the supply lines being tangent to the slot at one of the protrusions 111, whereas the other line 112 is tangent to the slot at a point equidistant from the protrusions 111.

It will be clear to those skilled in the art that the embodiments heretofore described are only presented by way of examples and can be modified in numerous ways without straying from the scope of the appended claims.

What is claimed is:

1. A dual-band planar antenna formed by at least a slot of closed shape fabricated on a printed substrate having a perimeter equal to $k\lambda_f$, and two supply lines supplying power to the slot via two accesses separated by $(2m+1)\lambda_f/4$, where $\lambda_f$ is the guided wavelength in the slot and k and m integers greater than 0, wherein the slot comprises means modifying the operating frequency, one of the supply lines being situated on the said means.

2. Antenna according to claim 1, wherein the means modifying the operating frequency are constituted by protrusions cut out from the slot.

3. Antenna according to claim 2, wherein the protrusions are placed on the inner rim of the slot.

4. Antenna according to claim 2, wherein the protrusions are placed on the outer rim of the slot.

5. Antenna according to claim 2, wherein the protrusions are square or rectangular in shape.

6. Antenna according to claim 5, wherein the dimensions of the protrusion as a function of the two operating frequencies are given by the equation:

$$2 \times \frac{f_2 - f_1}{f_2 + f_1} = A \times \frac{W_c L_c}{\pi R_{moy.}^2}$$

where $f_1$ and $f_2$ are the central operating frequencies on each of the supply lines, $W_c$ the width of the protrusion, $L_c$ the length of the protrusion, $R_{moy}$ the mean radius of the slot and A a multiplier coefficient.

7. Antenna according to claim 1, wherein the means modifying the operating frequency are formed by a symmetric gradual variation of one of the rims of the slot.

8. Antenna according to claim 7, wherein one of the rims is circular and the other elliptical.

9. Antenna according to claim 1, wherein the shape of the slot is annular, square, rectangular or in the form of a lozenge.

10. Antenna according to claim 1, wherein the supply lines are coupled with the slot according to a line-slot coupling of the Knorr type.

11. Antenna according to claim 1, wherein the supply lines are magnetically coupled with the slot according to a tangential line-slot transition.

* * * * *